United States Patent [19]

Bolick, II et al.

[11] Patent Number: 4,992,147

[45] **Date of Patent: * Feb. 12, 1991**

[54] ELECTROCHEMICAL PROCESS FOR PRODUCING HYDROSULFITE SOLUTIONS

[75] Inventors: Roger E. Bolick, II, Chattanooga; David W. Cawlfield; Jimmy M. French, both of Cleveland, all of Tenn.

[73] Assignee: Olin Corporation, Cheshire, Conn.

[ * ] Notice: The portion of the term of this patent subsequent to Dec. 27, 2005 has been disclaimed.

[21] Appl. No.: 190,630

[22] Filed: May 5, 1988

Related U.S. Application Data

[63] Continuation-in-part of Ser. No. 892,518, Aug. 4, 1986, Pat. No. 4,793,906.

[51] Int. Cl.[5] ..... C25B 1/00

[52] U.S. Cl. ..... 204/92; 204/263; 204/284

[58] Field of Search ..... 204/92, 284

[56] References Cited

U.S. PATENT DOCUMENTS

| | | | |
|---|---|---|---|
| 2,193,323 | 3/1940 | Nitzschke et al. | 204/9 |
| 2,273,799 | 2/1942 | Janes et al. | 204/94 |
| 3,523,069 | 8/1970 | Oloman | 204/92 |
| 3,748,238 | 7/1973 | Heit et al. | 204/92 |
| 3,920,551 | 9/1975 | Cook, Jr. et al. | 204/92 |
| 4,144,146 | 3/1979 | Leutner et al. | 204/92 |
| 4,326,938 | 4/1982 | Das Gupta et al. | 204/294 |
| 4,786,380 | 11/1988 | van Duin et al. | 204/284 |
| 4,793,906 | 12/1988 | Bolick et al. | 204/92 |

FOREIGN PATENT DOCUMENTS

| | | |
|---|---|---|
| 56-87682 | 7/1981 | Japan . |
| 1045675 | 10/1966 | United Kingdom . |

OTHER PUBLICATIONS

Ephraim, *Inorganic Chemistry,* 1943, pp. 549–550.

Oloman, C., "The Preparation of Dithionites by the Electrolytic Reduction of Sulphur Dioxide in Water", *J. Electrochem. Soc.: Electrochemical Technology,* Dec. 1970, pp. 1604–1609.

Kovacs, L., S. Muthukumaraswami, S. Krishnamurthy, R. Thangappan and H. V. K. Upuda, "Electrochemical Reduction of Sodium Bisulphite to Sodium Hydrosulphite in a Fluidized Bed Electrode", *Journal of Indian Technology,* vol. 14, Apr. 1976, pp. 184–188.

Gizetdinova, N. A., "Electrochemical Synthesis of Sodium Dithionite", Siberian Scientific-Research Institute of Paper and Cardboard, Translated from Zhurnal Prikladnoi Khimii, vol. 52, No. 12, pp. 2741–2744, Dec. 1979, original article submitted Aug. 7, 1978.

*Primary Examiner*—T. Tung

*Attorney, Agent, or Firm*—James B. Haglind; Paul Weinstein

[57] ABSTRACT

A process for electrolyzing an aqueous catholyte solution comprising an alkali meal bisulfite to produce an alkali metal hydrosulfite in an electrolytic membrane cell having a cation exchange membrane separating a cathode compartment from an anode compartment, a porous cathode having a face adjacent the membrane, a back opposite, and a porous structure conjoining the face and the back, and a cathode-membrane gap between the porous cathode and the cation exchange membrane. The process comprises directing at least 50 percent of the volume of the aqueous alkali metal bisulfite catholyte through the porous cathode and transverse to the face and back of the cathode, the porous cathode having a ratio of total surface area to the projected surface area of at least about 30:1.

High purity solutions of alkali metal hydrosulfites, such as sodium hydrosulfite having concentrations of at least 120 grams per liter, are produced at current densities in the range of 1.0 to 4.5 $KA/m^2$ and at reduced cell voltages. The thiosulfate impurity concentration is from 0 to about 10 percent by weight of the hydrosulfite.

14 Claims, 3 Drawing Sheets

ELECTROCHEMICAL PROCESS FOR PRODUCING HYDROSULFITE SOLUTIONS

This application is a Continuation-in-Part of U.S. Ser. No. 892,518, filed Aug. 4, 1986, now U.S. Pat. No. 4,793,906, issued Dec. 27, 1988.

The present invention relates to the electrochemical process for the manufacture of aqueous solutions of hydrosulfites. More particularly, the present invention relates to the electrochemical production of concentrated hydrosulfite solutions at high current densities.

Many unsuccessful attempts have been made at developing a process for manufacturing alkali metal hydrosulfites such as sodium hydrosulfite or potassium hydrosulfite electrochemically that can compete with conventional reduction processes using either sodium amalgam or metallic iron. The electrochemical process for making hydrosulfite results in the reduction of bisulfite ions to hydrosulfite ions. For this process to be economical, current densities must be employed which are capable of producing concentrated hydrosulfite solutions at high current efficiencies.

Further, where the solutions, which are strong reducing agents effective as bleaching solutions, are to be used in the paper industry, the undesirable by-product formation of thiosulfate as an impurity must be minimized. At high concentrations of hydrosulfite, however, this by-product reaction becomes more difficult to control.

Additionally, electrochemical routes to hydrosulfite produce aqueous solutions which are unstable and decompose at a rapid rate. This high decomposition rate of hydrosulfite appears to increase as the pH decreases or the reaction temperature increases. One approach to control the decomposition of hydrosulfite is to decrease the residence time of the hydrosulfite solution in the process. This can be accomplished by reducing the overall system volume and/or maintaining the current density as high as possible up to a critical density above which secondary reactions will occur due to polarization of the cathode.

Some of the processes of the prior art, which claim to make hydrosulfite salts electrochemically, require the use of water-miscible organic solvents such as methanol to reduce the solubility of the hydrosulfite and prevent its decomposition inside the cell. The costly recovery of the solvent and hydrosulfite makes this route uneconomical.

The use of zinc as a stabilizing agent for hydrosulfites in electrochemical processes has also been reported, but because of environmental considerations, this is no longer practiced commercially.

More recently, U.S. Pat. No. 4,144,146 issued Mar. 13, 1979 to B. Leutner et al describes an electrochemical process for producing hydrosulfite solutions in an electrolytic membrane cell. The process employs high circulation rates for the catholyte which is passed through an inlet in the bottom of the cell and removed at the top of the cell to provide for the advantageous removal of gases produced during the reaction. Catholyte flow over the surface of the cathodes is maintained at a rate of at least 1 cm per second where the cathode has a mesh spacing of 5 mm or less. The process is described as producing concentrated solutions of alkali metal hydrosulfites at commercially viable current densities; however, the cell voltages required were in the range of 5 to 10 volts resulting in high power consumption and high power costs and hence increased product costs. There is no indication of the concentrations of thiosulfate impurity in the product solutions.

Therefore, there is a need for an electrochemical process for producing aqueous solutions of alkali metal hydrosulfites having low concentrations of alkali metal thiosulfates as impurities at high current densities and at reduced cell voltages.

It is an object of the present invention to provide an electrochemical process for producing aqueous alkali metal hydrosulfite solutions having low concentrations of alkali metal thiosulfates as impurities.

Another object of the present invention is to provide an electrochemical process for producing concentrated alkali metal hydrosulfites which operates at high current densities.

These and other objects of the invention are accomplished in a process for electrolyzing an aqueous catholyte solution comprising an alkali metal bisulfite to produce an alkali metal hydrosulfite in an electrolytic membrane cell having a cation exchange membrane separating a cathode compartment from an anode compartment, a porous cathode having a face adjacent the membrane, a back opposite, and a porous structure conjoining the face and the back, and a cathode-membrane gap between the porous cathode and the cation exchange membrane, which process comprises directing at least 50 percent of the volume of the aqueous alkali metal bisulfite catholyte through the porous cathode and transverse to the face and back of the cathode, the porous cathode having a ratio of total surface area to the projected surface area of at least about 30:1.

According to the invention, it has been found that directing the flow of the catholyte through the porous cathode to maximize contact between the catholyte and the cathode results in significant improvements in the electrochemical process for producing aqueous alkali metal hydrosulfite solutions.

Figure 1:
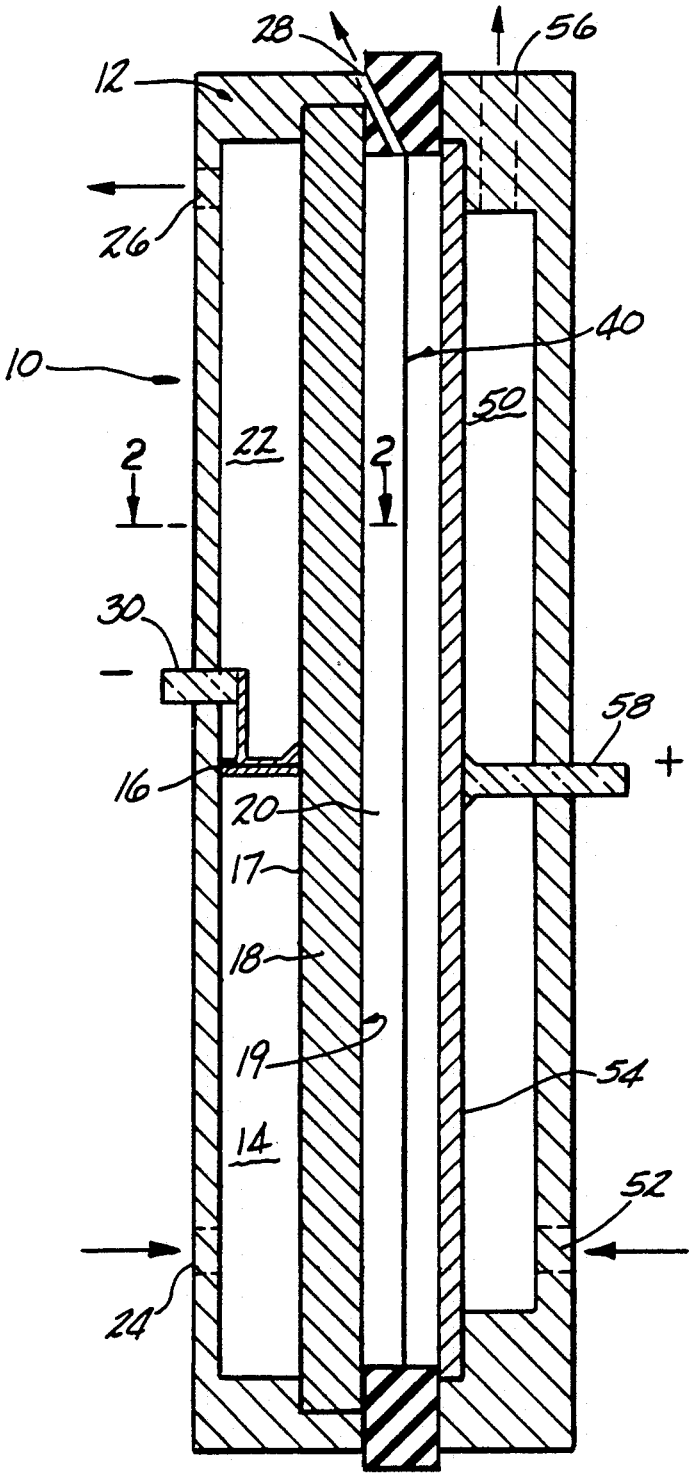
FIG. 1 illustrates a front perspective view of one embodiment of a membrane cell in which the novel process of the present invention may be operated.

As illustrated in FIG. 1, membrane electrolytic cell 10 has cathode compartment generally signified by 12 and anode compartment 50 separated by membrane 40. Cathode compartment 12 includes first catholyte zone 14, barrier 16, porous cathode 18, cathode-membrane gap 20, and second catholyte zone 22. During cell operation, an electrolyte is fed through inlet 24 into first catholyte zone 14. Barrier 16, positioned behind back 17 of porous cathode 18, serves to prevent or at least minimize the direct flow of electrolyte between first catholyte zone 14 and second catholyte zone 22. Thus at least a portion of the catholyte flows past back 17 of porous cathode 18 through porous cathode 18 and face 19 of porous cathode 18 into cathode-membrane gap 20. Cathode-membrane gap 20 is positioned between face 19 of porous cathode 18 and membrane 40. Catholyte in the cathode-membrane gap 20 flows upwards and back through porous cathode 18 into second catholyte zone 22, and is removed from catholyte zone 22 through outlet 26. Where a gas is produced in cathode compartment 12, it is removed through gas outlet 28. Cathode current conductor 30 is connected to barrier 16 and to back 17 of porous cathode 18. Anode compartment 50 includes inlet 52, anode 54, outlet 56, and anode current conductor 58.

Figure 3:
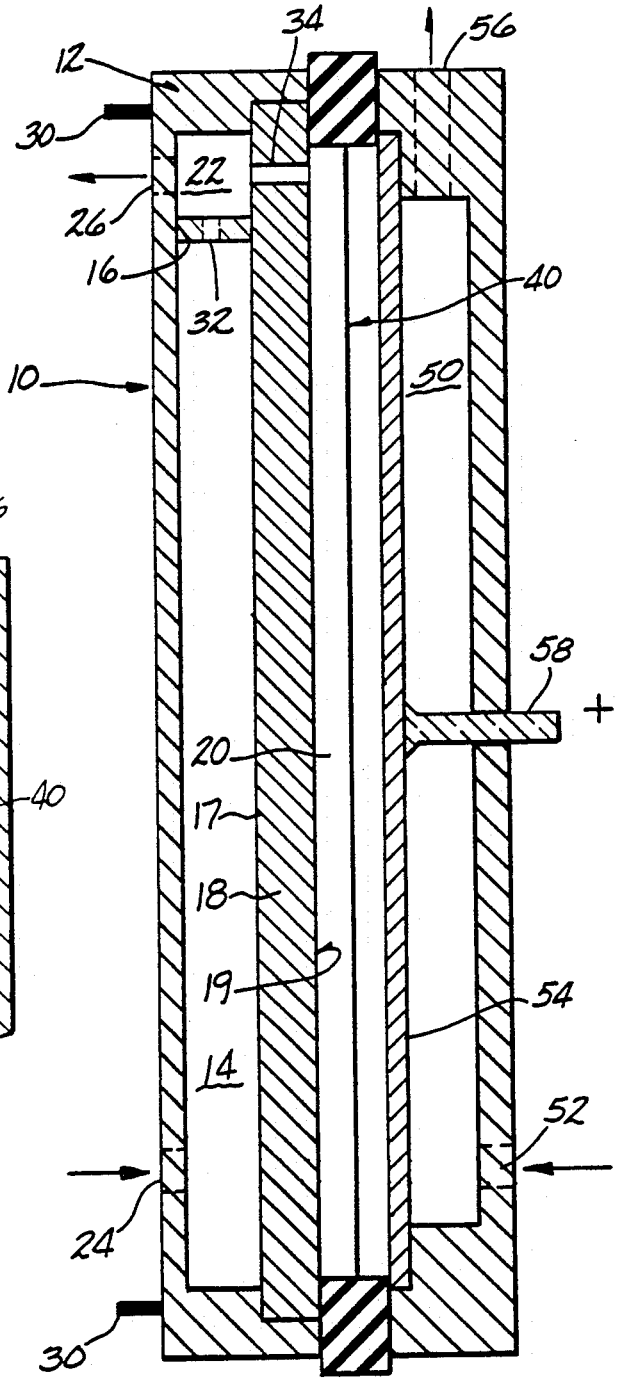
FIG. 3 shows a front perspective view of another embodiment of a membrane cell suitable for the operation of the novel process of the present invention.

Electrolytic cell 10, as shown in FIG. 3, includes cathode compartment 12, and anode compartment 50 separated by membrane 40. Cathode compartment 12 includes first catholyte zone 14, barrier 16, porous cathode 18, cathode-membrane gap 20, second catholyte zone 22, and cathode current conductor 30. During cell operation, an electrolyte is fed through inlet 24 into first catholyte zone 14. Barrier 16 directs the flow of the electrolyte through porous cathode 18 into cathode membrane gap 20. Barrier 16 contains orifice 32 which permits fluid flow between first catholyte zone 14 and second catholyte zone 22. Catholyte in the cathode-membrane gap 20 flows upward and through outlet 34 into second catholyte zone 22. The catholyte and any gas produced are removed from catholyte zone 22 through outlet 26. Anode compartment 50 includes inlet 52, anode 54, outlet 56, and anode current conductor 58.

Figure 5:
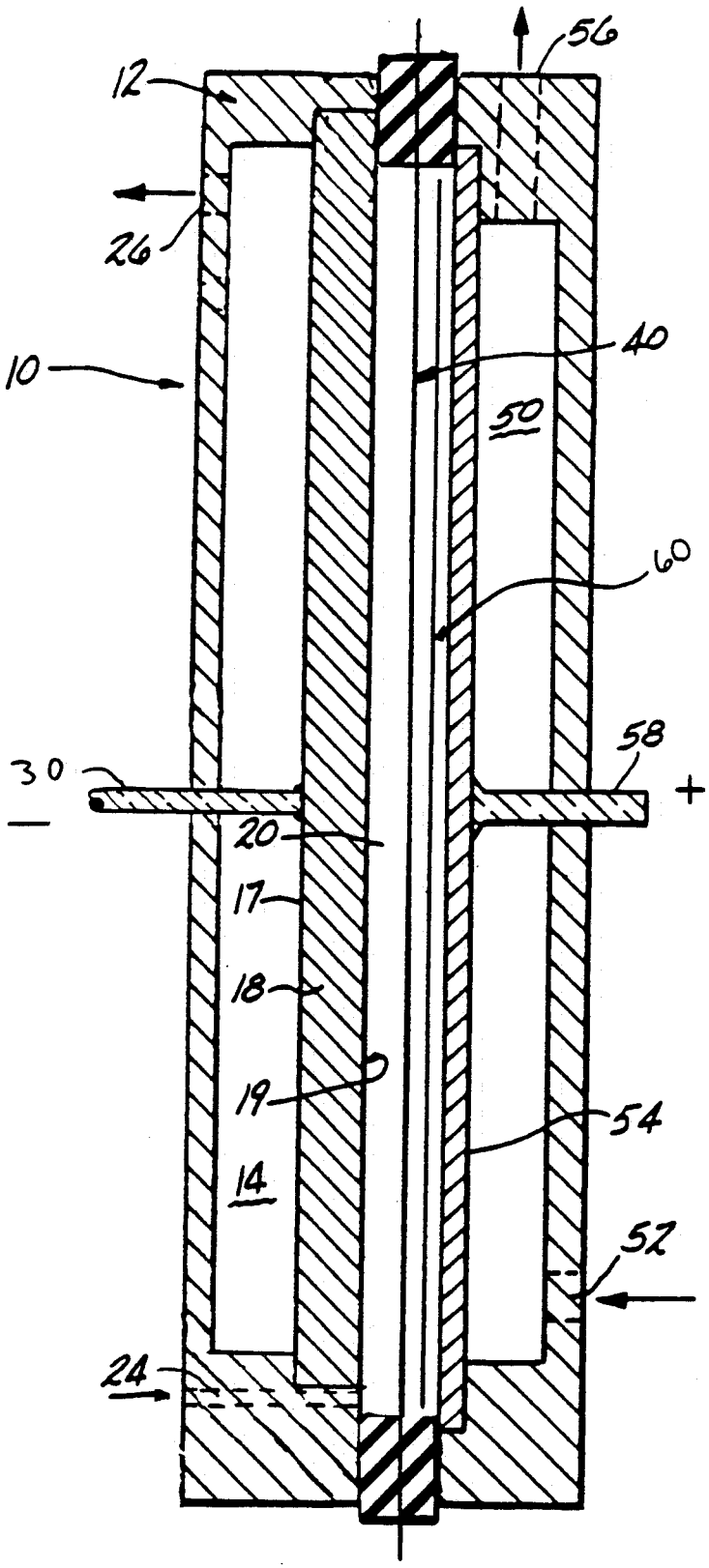
FIG. 5 depicts a front perspective view of a further embodiment of a membrane cell suitable for employing the novel process of the present invention.

Membrane electrolytic cell 10 depicted in FIG. 5 is divided by membrane 40 into cathode compartment 12 and anode compartment 50. Cathode compartment 12 includes catholyte zone 14, porous cathode 18 and cathode-membrane gap 20. During cell operation an electrolyte is fed through inlet 24 into cathode-membrane gap 20 and along face 19 of porous cathode 18. The electrolyte is directed across face 19, through the porous cathode and across back 17 into catholyte zone 14. The catholyte is removed from catholyte zone 14 through outlet 26. Anode compartment 50 includes anode 54 and porous mesh 60 positioned between anode 54 and membrane 40.

In the novel process of the present invention a buffered aqueous solution of an alkali metal bisulfite is electrolyzed in the cathode compartment. The alkali metal bisulfite solution, containing at least about 50 grams per liter of $NaHSO_3$, may be produced, for example, by the reaction of an aqueous solution of an alkali metal sulfite with sulfur dioxide gas. While this reaction may be carried out, for example, in the first catholyte zone of the cathode compartment, it is preferable to produce the buffered bisulfite solution outside of the cell where careful admixing of the reactants can continuously produce an alkali metal bisulfite solution having a pH within the desired range. The buffered bisulfite solution is fed into the cathode compartment and a portion directed through the porous cathode. Bisulfite ions are electrolytically reduced to hydrosulfite ions (dithionite ions) while the catholyte solution flows through the porous cathode and along the face or the back of the cathode.

The bisulfite reduction is believed to be represented by the following equation:

$$4NaHSO_3 + 2e^- + 2Na^+ \rightarrow Na_2S_2O_4 + 2Na_2SO_3 + 2H_2O.$$

Thiosulfate ion formation which results from the decomposition of hydrosulfite is believed to be represented as follows:

$$Na_2S_2O_4 + 2e^- + 2Na^+ + 2NaHSO_3 \rightarrow Na_2S_2O_3 + 2Na_2SO_3 + H_2O.$$

This hydrosulfite decomposition reaction is electrolytically driven by the presence of electrons. When the potential is increased, so is the current density and to a point, the reaction rate of this undesired thiosulfate producing reaction.

By directing the catholyte flow through the porous cathode, for example, from the first catholyte zone into the cathode-membrane gap, increase contact is provided between the catholyte and the porous cathode. Employing cathodes having high total surface area to volume ratios requires less voltage or a low potential to drive the primary reduction reaction that produces the desired hydrosulfite product and, thereby, reduces the amount of the undesired thiosulfate produced by the hydrosulfite decomposition reaction. The increased catholyte contact and the increased cathode surface area permits the potential to be maintained at a lower level where the desired hydrosulfite producing reaction predominates and generally below the level where hydrosulfite decomposition becomes a factor.

In a preferred embodiment of the invention, continuous circulation of the catholyte through the cathode compartment is maintained at rates which minimize the formation of impurities such as alkali metal thiosulfates. Suitable catholyte circulation rates are those which prevent a pH change of greater than about 0.5 unit per pass through the cathode compartment. Preferably the pH change is less than about 0.3 unit per pass through the cathode compartment. During the electrolysis, the pH of the aqueous solution is maintained in the range of from about 5.0 to about 6.5, and preferably at about 5.2 to about 6.2, and more preferably at from about 5.5 to about 6.0. The temperature of the catholyte is maintained in the range of from about 0° to about 35° C., depending on the hydrosulfite concentration. Preferably the catholyte temperature is at least 15° C.

In the operation of the novel electrolytic process described above, the circulation rate of the anolyte solution approximates that of the catholyte solution to prevent stretching or tearing of the membrane by creating excessive differential pressures. Suitable circulation rates for the catholyte and anolyte are those which maintain the differential pressure at no greater than about 5, preferably from 0 to 2, and more preferably from 0 to about 0.5 psi.

During cell operation the barrier means directs at least 30 percent, preferably at least 50 percent, more preferably from at least 70, and even more preferably from about 80 to about 100 percent, by volume of the catholyte through the pores of the porous cathode. Lower volumes of catholyte may be directed by the barrier where the catholyte flows from the first catholyte zone through the porous cathode into the cathode-membrane gap, along the cathode-membrane gap, and then back through the porous cathode into the second catholyte zone.

The barrier means may be positioned at any suitable location to separate first catholyte zone 14 from second catholyte zone 22. Where a membrane cell of the type illustrated in FIG. 3 having an opening in the porous cathode for catholyte flow is employed, the process is preferably operated by the direction of larger volumes of the catholyte through the porous cathode. The location of the opening (outlet 34) is not critical and may be positioned in the upper portion as illustrated in FIG. 3 or in the lower portion if desired. While barrier 16 is preferably located adjacent to the back of the porous cathode, it may be positioned in the cathode-membrane gap or it may be omitted where the aqueous solution of alkali metal bisulfite enters the cathode compartment by being fed into the cathode membrane gap and is directed across the face of and through the porous cathode.

Figure 2:
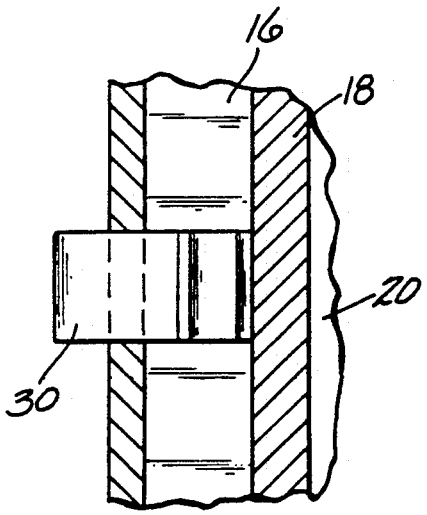
FIG. 2 depicts a schematic partial sectional view of FIG. 1 taken along line 2-2.
Figure 4:
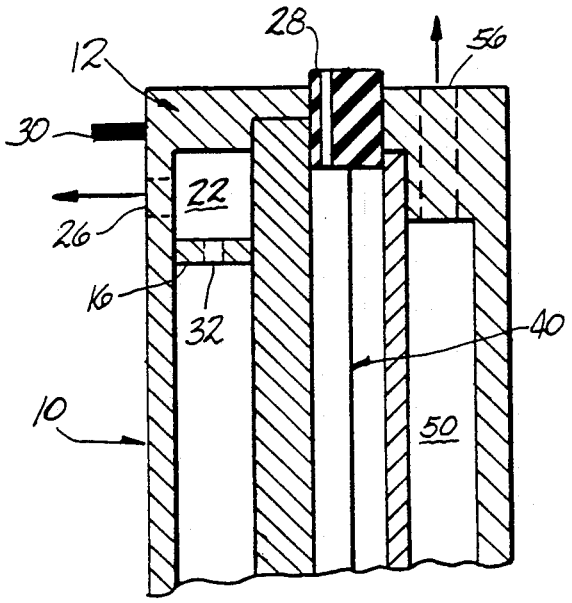
FIG. 4 illustrates a partial front perspective view of an additional embodiment of a membrane cell suitable for the operation of the novel process of the present invention.

As noted above and in accordance with the invention, the design of the barrier means can be made to substantially block the flow of catholyte, or to permit the flow of varying amounts of catholyte between the first and second catholyte zones. Thus the barrier means can be substantially solid, as illustrated in FIG. 2, or foraminous or non-continuous as shown in FIGS. 3 and 4. More than one barrier means may be employed where it is desired to direct the portion of the catholyte in multiple passes through the porous cathode.

Cathode current conductor 30 may be directly connected to the barrier means and the cathode as shown in FIGS. 1 and 2, or separately connected to the cathode compartment as shown in FIG. 3.

The alkali metal hydrosulfite solution produced by the novel process of the invention contains commercial concentrations of the alkali metal hydrosulfite, varying concentrations of alkali metal bisulfite and alkali metal sulfite, and has concentrations of alkali metal thiosulfate as an impurity, for example, from 0 to about 10 percent by weight based on the weight of hydrosulfite.

The anolyte which is electrolyzed in the anode compartment is any suitable electrolyte which is capable of supplying alkali metal ions and water molecules to the cathode compartment. Suitable as anolytes are, for example, alkali metal halides, alkali metal hydroxides, or alkali metal persulfates. The selection of anolyte is in part dependent on the product desired. Where a halogen gas such as chlorine or bromine are wanted, an aqueous solution of an alkali metal chloride or bromide is used as the anolyte. Alkali metal hydroxide solutions are chosen where oxygen gas or hydrogen peroxide is to be produced. If persulfuric acid is the desired product, an alkali metal persulfate is employed. In any case, concentrated solutions of the electrolyte selected are employed as the anolyte. For example, where a sodium chloride is selected as the alkali metal chloride, suitable solutions such as anolytes contain from about 17 to about 35 percent by weight of NaCl. Solutions of alkali metal hydroxides such as sodium hydroxide contain from about 5 to about 40 percent by weight of NaOH.

The process of the present invention is operated at current densities which are sufficiently high enough to produce solutions of alkali metal hydrosulfites having the concentrations desired. For example, where sodium hydrosulfite is produced, for commercial sale, the solutions contain from about 120 to about 160 grams per liter. However, as the alkali metal hydrosulfite solutions sold commercially are usually diluted before use, these dilute aqueous solutions can also be produced directly by the process. The novel electrochemical process is normally operated continuously but may be operated in a non-continuous or batchwise manner.

Current densities of at least 0.5 kiloamps per square meter are employed. Preferably the current density is in the range of from about 1.0 to about 4.5, and more preferably at from about 2.0 to about 3.0 kiloamps per square meter.

At these high current densities, the novel process of the present invention operates to produce high purity alkali metal hydrosulfite solutions which can be employed commercially without further concentration or purification.

The electrolytic membrane cell used in the process of the present invention employs, as a separator between the anode and the cathode compartments, a cation exchange membrane which prevents any substantial migration of sulfur-containing ions from the cathode compartment to the anode compartment. A wide variety of cation exchange membranes can be employed containing a variety of polymer resins and functional groups.

Employed are cation exchange membranes which are inert, flexible membranes, and are substantially impervious to the hydrodynamic flow of the electrolyte and the passage of gas products produced in the cell. Cation exchange membranes are well-known to contain fixed anionic groups that permit intrusion and exchange of cations, and exclude anions, from an external source. Generally the resinous membrane or diaphragm has as a matrix, a cross-linked polymer, to which are attached charged radicals such as $—SO_3^=$, $—COO^-$, $—PO_3^=$, $—HPO_2^=$, $—AsO_3^=$, and $—SeO_3^=$ and mixtures thereof. The resins which can be used to produce the membranes include, for example, fluorocarbons, vinyl compounds, polyolefins, and copolymers thereof. Preferred are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid group" and "carboxylic acid groups" are meant to include salts of sulfonic acid or salts of carboxylic acid groups by processes such as hydrolysis. Suitable cation exchange membranes are sold commercially by E. I. DuPont de Nemours & Co., Inc., under the trademark "Nafion"; by the Asahi Glass Company under the trademark "Flemion"; and by the Asahi Chemical Company under the trademark "Aciplex".

The membrane separator is positioned between the anodes and the cathodes and is separated from the cathode by a cathode-membrane gap which is wide enough to permit the catholyte to flow between the face of the cathode and the membrane from the first catholyte zone to the second catholyte zone and to prevent gas blinding but not wide enough to substantially increase electrical resistance. Depending on the form of cathode used, the cathode-membrane gap is a distance of from about 0.05 to about 10, and preferably from about 1 to about 4 millimeters. The cathode-membrane gap can be maintained by hydraulic pressure or mechanical means.

The catholyte flow path permits almost all of the catholyte liquid to contact the active area of the cathode. Further, the majority of the electrolytic reaction occurs in the cathode area nearest the anode.

Cathodes used in the cathode compartment are porous structures which readily permit the flow of the catholyte solution through the pores or openings of the cathode structure at rates which maintain the desired reaction conditions. Suitable cathodes have at least one layer having a total surface area to volume ratio of greater than 100 $cm^2$ per $cm^3$, preferably 250 $cm^2$ per $cm^3$, and more preferably greater than 500 $cm^2$ per $cm^3$. These structures have a porosity of at least 60 percent and preferably from about 70 percent to about 90 percent, where porosity is the percentage of void volume. The ratio of total surface area to the projected surface area of the porous cathodes, where the projected surface area is the area of the face of the cathode, is at least about 30:1 and preferably at least from about 50:1, for example, from about 80:1 to about 100:1.

Employing the novel process of the invention, concentrated alkali metal hydrosulfite solutions are produced having low concentrations of alkali metal thiosulfates as an impurity in electrolytic membrane cells operating at high current densities, substantially reduced cell voltages, and high current efficiencies.

The following examples further illustrate the process of the present invention without the intention of being limited thereby.

EXAMPLE 1

An electrochemical cell of the type shown in FIGS. 1-2 was employed. In the cathode compartment a porous cathode of 304 stainless steel felt metal (0.318 cm. thick) having a porosity of 80 percent, a projected surface area of 206 $cm^2$, and a total surface to volume ratio of 320 $cm^2$ per $cm^3$ was mounted. A sheet of 316 stainless steel was attached to the back of the porous cathode to divide the cathode chamber into a first catholyte zone and a second catholyte zone. A current conductor was mounted on the stainless steel barrier. A cation exchange membrane (Nafion® 906, manufactured by E. I. DuPont de Nemours & Co., Inc.) was mounted in the cell spaced apart from the face of the porous cathode by 2 to 3 mm. An aqueous electrolyte solution containing an average concentration of 75 gpl of sodium bisulfite and 25 gpl sodium sulfite, produced by feeding $SO_2$ gas into an aqueous NaOH solution, was initially fed to the first catholyte zone and continuously circulated through the cathode compartment. The flow of catholyte through the inlet was directed at the bottom backside of the porous cathode where it flowed below the barrier and through the porous cathode into the cathode-membrane gap. The catholyte flowed along the membrane, past the barrier and then back through the porous cathode into the second catholyte zone and out the outlet. The catholyte was circulated at a rate of 0.5 liter per minute, and sulfur dioxide continuously added to replenish the catholyte pH. The catholyte was maintained at 5.6±0.1. The anode compartment contained an anode formed of vertically positioned nickel rods. A polypropylene mesh separator was placed between the face of the anode and the membrane. An aqueous solution of NaOH (30 percent by weight) was fed to the anode compartment and circulated at a rate of 0.5 liter per minute. A current density of 2.0 $KA/m^2$ was applied to the electrodes. The cell operated for a period of 69 days at a cell voltage in the range of 2.8 to 3.4 volts. The sodium hydrosulfite solution produced had an average concentration of 145 grams per liter (gpl) of $Na_2S_2O_4$, 75 gpl of $NaHSO_3$, 25 gpl $Na_2SO_3$, and 7 gpl of $Na_2S_2O_3$. The current efficiency averaged 90 percent.

EXAMPLE 2

The electrolytic membrane cell of EXAMPLE 1 was employed using a stainless steel felt metal cathode having a porosity of 85 percent and a projected surface area of 206 $cm^2$ with a total surface area to volume ratio of 750 $cm^2$ per $cm^3$. The cation exchange membrane was Nafion® 906 (manufactured by E. I. DuPont de Nemours & Co., Inc.). The initial catholyte contained an average of 80 gpl of $NaHSO_3$ and 18 gpl of $Na_2SO_3$. During operation, sulfur dioxide and water were added to maintain these buffer concentrations. Sodium hydroxide and water were added to the anode compartment during operation to maintain an average concentration of 25 percent by weight of NaOH. The cell was operated at the same circulation rates as EXAMPLE 1 and at a current density of 2.25 $KA/m^2$ for a period of days to produce a sodium hydrosulfite solution having an average concentration of 155 gpl of $Na_2S_2O_4$ and 5 gpl of $Na_2S_2O_3$. The cell voltage was in the range of 2.7 to 3.1 volts and the current efficiency was approximately 90 percent.

EXAMPLE 3

The electrolytic membrane cell of EXAMPLE 1 was employed using 430 stainless steel felt metal cathode area having a projected surface area of 206 $cm^2$, a total surface area to volume ratio of 146 $cm^2$ per $cm^3$, and a porosity of 80 percent. The anolyte was a brine containing 25 percent by weight of NaCl and as the initial catholyte a solution of 90 gpl of $NaHSO_3$ which was circulated at 0.6 liter per minute. At a current density of 1.5 $KA/m^2$, the cell operated at 3.78 volts to produce a sodium hydrosulfite solution containing 147.5 gpl Na , 72.2 gpl $NaHSO_3$, 12.1 gpl $Na_2SO_3$, and 8.9 gpl $Na_2S_2O_3$. During cell operation the pH of the catholyte was maintained at 5.6±0.2 by adding sulfur dioxide to the circulating catholyte. The cell temperature was 27 ° C. The overall cell current efficiency was 88 percent.

EXAMPLE 4

The cell of EXAMPLE 3 was modified to use a nickel metal felt cathode having a porosity of 70 percent and a total surface area to volume ratio of 765 $cm^2$ per $cm^3$. The cell operated at a current density of 2.0 $KA/m^2$ and a cathode voltage of 4.48 volts. At a cell temperature of 23° C., a product solution containing 132.2 gpl of $Na_2S_2O_4$, 90.6 gpl $Na_2HSO_3$, 15.22 gpl $Na_2SO_3$, and 10.2 gpl of Na was produced. The cell current efficiency was 85.5 percent.

EXAMPLE 5

The process of EXAMPLE 4 was repeated using the nickel felt metal cathode which was plated with 0.5 g. of silver. The cell was operated at a current density of 2.0 $KA/m^2$ to produce a solution containing 151.5 gpl $Na_2S_2O_4$, 90.4 gpl $NaHSO_3$, 19.5 gpl $Na_2SO_3$, and 8.6 gpl of $Na_2S_2O_3$. The cell voltage was 4.74 volts and the current efficiency was 90 percent.

EXAMPLE 6

The electrolyte membrane cell of EXAMPLE 3 was employed using as the cathode a 347 stainless steel felt metal having a total surface area to volume ratio of 1,322 $cm^2$ per $cm^3$ and a porosity of 70 percent. The cell was operated at a current density of 2.0 $KA/m^2$ and a cell voltage of 4.1 volts to produce an aqueous hydrosulfite solution containing 134.5 gpl $Na_2S_2O_4$, 78 gpl $NaHSO_3$, 9.3 gpl $Na_2SO_3$, and 6.8 gpl $Na_2S_2O_3$. The overall cell current efficiency was 91 percent.

EXAMPLE 7

Two electrochemical cells of the type shown in FIG. 5 were connected in series for electrical flow and in parallel for electrolyte flow. In each cathode compartment a porous cathode of 304 stainless steel felt metal (0.318 cm thick) having a porosity of 85 percent, a projected surface area of 79 $cm^2$, and a total surface area to volume ration of 320 $cm^2$ per $cm^3$ was mounted The catholyte solution was fed into the cathode membrane gap through a set of holes in the cell frame itself, passed through the cathode, and then exiting the area behind the cathode through another set of holes in the cell frame. A cation exchange membrane Nafion® 906 (manufactured by E. I. DuPont de Nemours & Co., Inc.) was mounted in the cell spaced apart from the face of the porous cathode by 2 to 3 mm. A 7.0 weight percent NaOH solution was fed to the catholyte circulation loop, as was gaseous $SO_2$ to maintain the pH of the catholyte solution at 5.6+/−0.1 units. The catholyte solution feed was maintained so that the catholyte concentrations averaged 151 gpl sodium hydrosulfite, 5 gpl sodium thiosulfate, 80 gpl sodium bisulfite, and 16 gpl sodium sulfite. The catholyte was circulated at 0.5 liters/min and cooled with chilled ethylene glycol solution in a glass exchanger to maintain a catholyte temperature of 28°+/−1° C. The anode compartments contained anodes formed of vertically positioned nickel rods. Polypropylene mesh separators were placed between the face of the anodes and the membranes. An aqueous solution of NaOH (18.5 percent by weight) was fed to the anode circulation loop which was also circulated at a rate of 0.5 liters/min. A current density of between 2.5 and 2.9 $KA/m^2$ was applied to the electrodes. The cells were operated for five hours with individual cell voltages in the range of 2.61 to 2.93 volts. The current efficiency for the system averaged 94 percent.

What is claimed is:

1. A process for electrolyzing an aqueous catholyte solution comprising an alkali metal bisulfite to produce an alkali metal hydrosulfite in an electrolytic membrane cell having a cation exchange membrane separating a cathode compartment from an anode compartment, a porous cathode having a face adjacent the membrane, a back, a porous structure conjoining the face and the back, a first catholyte zone adjacent to the back of the cathode, a second catholyte zone separated from the first catholyte zone by a barrier means, and a cathode-membrane gap between the porous cathode and the cation exchange membrane, which process comprises feeding at least 50 percent of the volume of the aqueous alkali metal bisulfite catholyte to the first catholyte zone and through the porous cathode, the porous cathode having a ratio of total surface area to the projected surface area of at least about 30:1.

2. The process of claim 1 in which the alkali metal bisulfite is sodium bisulfite or potassium bisulfite; and the alkali metal hydrosulfite is correspondingly sodium hydrosulfite or potassium hydrosulfite.

3. The process of claim 2 in which a pH of the aqueous catholyte solution is maintained at from about 5.0 to about 6.5

4. The process of claim 3 in which the aqueous catholyte solution is circulated at a rate which prevents a pH change of greater than about 0.5 unit per pass through the cathode compartment.

5. The process of claim 4 in which the ratio of total surface area to the projected surface area of the porous cathode is at least about 50:1.

6. The process of claim 4 in which the porosity of the porous cathode is at least 60 percent.

7. The process of claim 3 in which a cell temperature in the range of from about 0° to about 35° C. is maintained.

8. The process of claim 4 in which a current density is in the range of from about 1.0 to about 4.5 kiloamps per square meter.

9. The process of claim 1 in which the aqueous catholyte solution and an aqueous anolyte solution are circulated at rates which maintain the differential pressure across the membrane at no greater than about 5 psi.

10. The process of claim 1 in which an aqueous anolyte solution selected from the group consisting of alkali metal hydroxides, alkali metal persulfates, and alkali metal halides is fed to anode compartment.

11. The process of claim 10 in which the aqueous catholyte solution and the aqueous anolyte solution are circulated at rates which maintain the differential pressure across the membrane at no greater than about 5 psi.

12. The process of claim 10 in which the aqueous catholyte solution is circulated at a rate which prevents a pH change of greater than about 0.5 unit per pass through the cathode compartment.

13. The process of claim 12 in which the ratio of total surface area to the projected surface area of the porous cathode is at least about 50:1.

14. The process of claim 12 in which the ratio of total surface area to the projected surface area of the porous cathode is from about 80:1 to about 100:1.

* * * * *